United States Patent [19]

Schuberth et al.

[11] 4,238,754

[45] Dec. 9, 1980

[54] VARIABLE RESISTOR

[75] Inventors: Christian Schuberth; Istvan Nemeth, both of Bad Neustadt; Lothar Guck, Reyersbach, all of Fed. Rep. of Germany

[73] Assignee: Elektrofeinmechanische Werke Jacob Preh GmbH & Co., Fed. Rep. of Germany

[21] Appl. No.: 927,863

[22] Filed: Jul. 25, 1978

[30] Foreign Application Priority Data

Aug. 5, 1977 [DE] Fed. Rep. of Germany ..... 2735352
Sep. 9, 1977 [DE] Fed. Rep. of Germany ..... 2740578

[51] Int. Cl.[3] ..... H01C 10/34
[52] U.S. Cl. ..... 338/174; 338/132
[58] Field of Search ..... 338/174, 132, 130, 131, 338/162, 128

[56] References Cited

U.S. PATENT DOCUMENTS

| | | | |
|---|---|---|---|
| 2,632,830 | 3/1953 | Aust et al. | 338/174 X |
| 3,581,265 | 5/1971 | Fako | 338/174 |
| 3,676,822 | 7/1972 | Slagg et al. | 338/132 |
| 3,832,671 | 8/1974 | Kohima | 338/188 |
| 3,997,864 | 12/1976 | Oka et al. | 338/162 X |

FOREIGN PATENT DOCUMENTS

| | | | |
|---|---|---|---|
| 333179 | 8/1930 | United Kingdom | 208/179 |
| 763615 | 12/1956 | United Kingdom | 334/1 |
| 832612 | 4/1960 | United Kingdom | 338/118 |
| 1088450 | 10/1967 | United Kingdom | 338/132 |
| 1185942 | 3/1970 | United Kingdom | 208/179 |
| 1338377 | 11/1973 | United Kingdom | 338/163 |

*Primary Examiner*—C. L. Albritton
*Attorney, Agent, or Firm*—Thomas E. Beall, Jr.

[57] ABSTRACT

A variable resistor of modular design having a hub-flange and at least one housing frame having a central opening. A spring carrier provided with a contact spring is arranged in the central opening of the housing and is rotatable by means of an actuation shaft. A carrier plate, on which the resistor course and the collector course are mounted, is positioned adjacent the spring carrier such that the contact spring provides an electrical connection between the resistance and the collector courses. The housing frame has a pot-shaped front side for receiving a rotor. Means is provided for arresting rotation of the rotor to within predetermined angular limits, and the rotor has a contoured rim for engaging a click-stop device.

27 Claims, 9 Drawing Figures

(A-B)

(C-D)

VARIABLE RESISTOR

BACKGROUND OF THE INVENTION

1. Field of the Invention

The invention relates to an arrangement for plural variable resistors on a common actuation shaft.

2. The Prior Art

In order to enable reasonable and low-cost production of the numerous variations demanded by the user of one type of variable resistor, variable resistors are assembled in the so-called modular fashion. In this way, it is more readily possible to fulfil the requirements of the user for single-, tandem-, duplotandem-, duotandem-, doubletandem-, etc., variable resistors, with specified requirements as to shaft configurations and resistance values, with a resistor whose major components are the same for all variations.

A variable resistor is already known which is modularly constructed such that several modules of the same kind are couplable with one another. Each module consists of a pot-shaped housing having a front and a back surface. A spring carrier is rotatably mounted in the housing with the aid of a shaft which extends through a central opening in the housing. A contact spring is mounted on the spring carrier, the contacts of the spring resiliently resting against a resistance course as well as against a collection course. The resistance course is mounted on a carrier plate which forms the end of the pot-shaped housing. The collector is developed as a planar collector ring with a central opening, the ring being arranged in the bottom of the pot-shaped housing and having a central opening through which the shaft extends. Thus, the contacts of the contact spring are arranged on different sides of the spring carrier. The housing itself is connected, by a locating plate, with an externally threaded hub-flange.

To obtain better protection against unintentional adjustment of the variable resistor and to obtain precisely defined resistance values, for example, for use with volume control systems, conventional variable resistors are additionally provided with a click-stop device. Ordinarily, an odd number of stops is chosen in order to make possible a defined center position, for example, when used for audio adjustment. If precision adjustment is required, as many as 41 stop-positions may be provided. With simpler apparatus, a single center-position stop may suffice.

A variable resistor having a click-stop device, consisting of a hub-flange on which a carrier plate is mounted for carrying the resistance course and the collector course, is already known. An actuation shaft extends through the hub-flange; on one end of the actuation shaft a spring carrier is mounted. On the side of the spring carrier turned towards the carrier plate, a contact spring is mounted with its contacts lying resiliently against the resistance and collector courses in order to produce an electrical connection between the two courses. A row of dome-like elevations are provided along a circumference at a predetermined radius from the axis of said spring carrier, and said elevations cooperate with two diametrically-opposed projecting noses of a stop-spring. This stop-spring is arranged on a pot-shaped housing which surrounds the entire variable resistor and which is mounted on the carrier plate. It is a disadvantage that this click-stop device is not readily transferable to a variable resistor of modular design.

With known variable resistors, each spring carrier is ordinarily turned independently by the actuation shaft. Because the coupling between the spring carrier and the shaft is a loose one and the construction parts participating in the transmission of the turning movement are subject to the usual functional tolerances, a relatively low level of synchronous precision results for tandem resistors of this type. By the term synchronous is meant the electrical uniformity of the individual resistance values realized within a predetermined actuation zone. The measurement is done by a voltage comparison in which the synchronous tolerance is calculated in dB from the common logarithm of the ratio between the two voltages tapped, multiplied by a factor of 20. With known variable resistor arrangements, a synchronism of only 3 dB can be attained. For high-quality apparatus, however, synchronism conditions of 1 dB and less are required.

A tandem resistor is already known in which the actuation shaft between the mounting positions of the two spring carriers has a reduced cross-section. This cross-section reduction is obtained by an indentation of the shaft, or by using two surface millings symmetrically displaced 180° apart, or by means of a transverse bore through the shaft. Torsional stress on the actuation shaft causes a deformation at the portion with reduced cross-section, such that the spring carriers mounted on the actuation shaft can be turned relative to one another. In this manner, a synchronisation correction is made possible. To facilitate the twisting, the end of the actuation shaft is provided with a screw driver slot. With this arrangement it is disadvantageous that no possibility of having a detent position exists.

SUMMARY OF THE INVENTION

Therefore, it is the purpose of the invention to provide a variable resistor of modular design, the variable resistor providing in a very small space a simple, easily exchangeable click-stop device with as many stop positions as possible, and at the same time to limit the angular rotation zone.

A further purpose of the present invention is to improve the synchronous precision of such a variable tandem resistor.

These purposes are satisfied by the invention in that one of the housing frames has a pot-shaped front side, between the walls of which a rotor provided with an arresting segment is mounted for rotation. The rotor has a stop contour on the side turned away from the housing frame in which a click-stop device, biased by a resilient member, engages.

BRIEF DESCRIPTION OF THE DRAWINGS

Two preferred embodiments of the invention will now be described in detail with reference to FIGS. 1 to 9, in which.

DETAILED DESCRIPTION OF THE PREFERRED EMBODIMENTS

Figure 1:
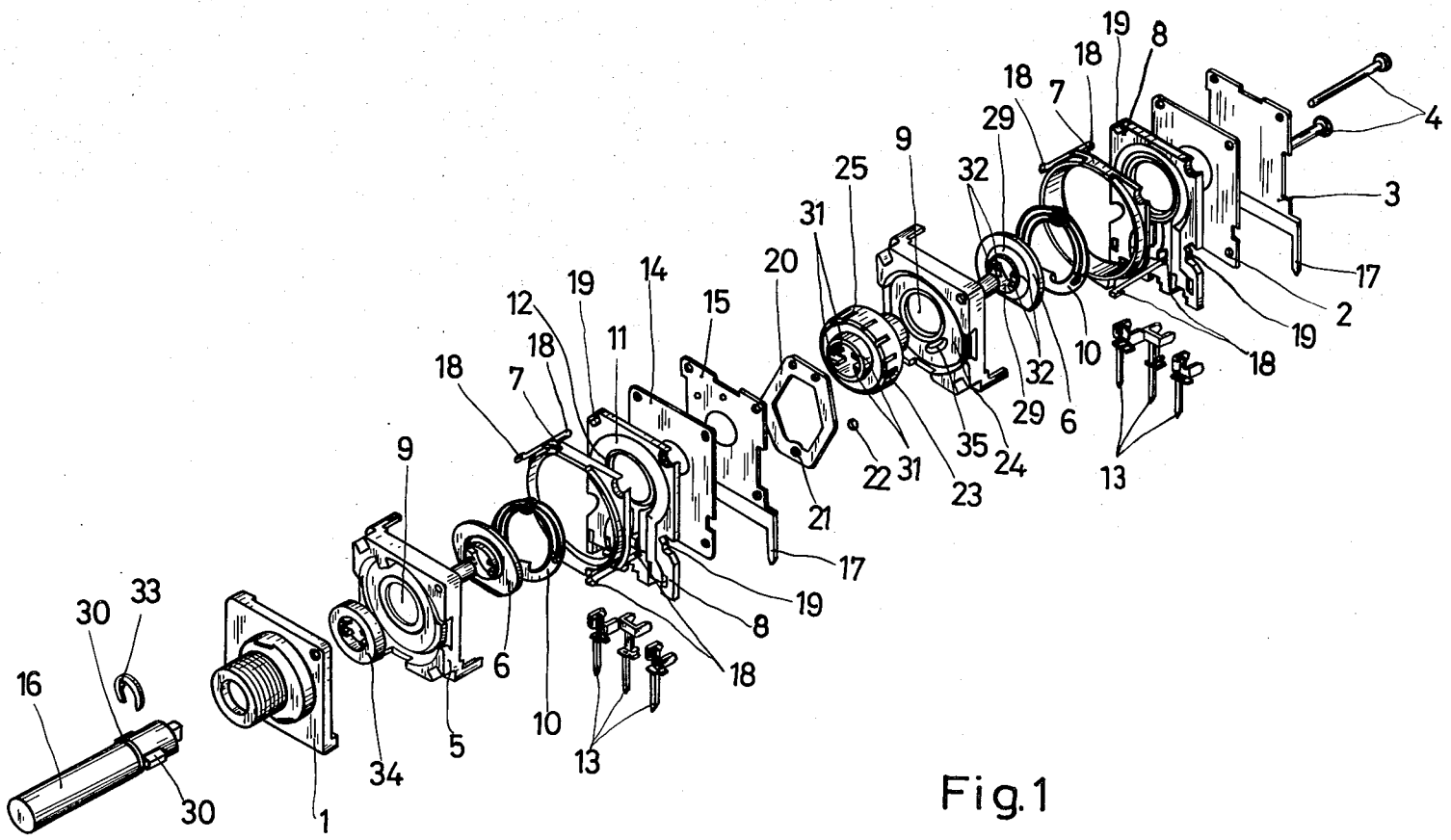
FIG. 1 shows an exploded, perspective view of a first embodiment of the variable tandem resistor according to the invention.
Figure 2:
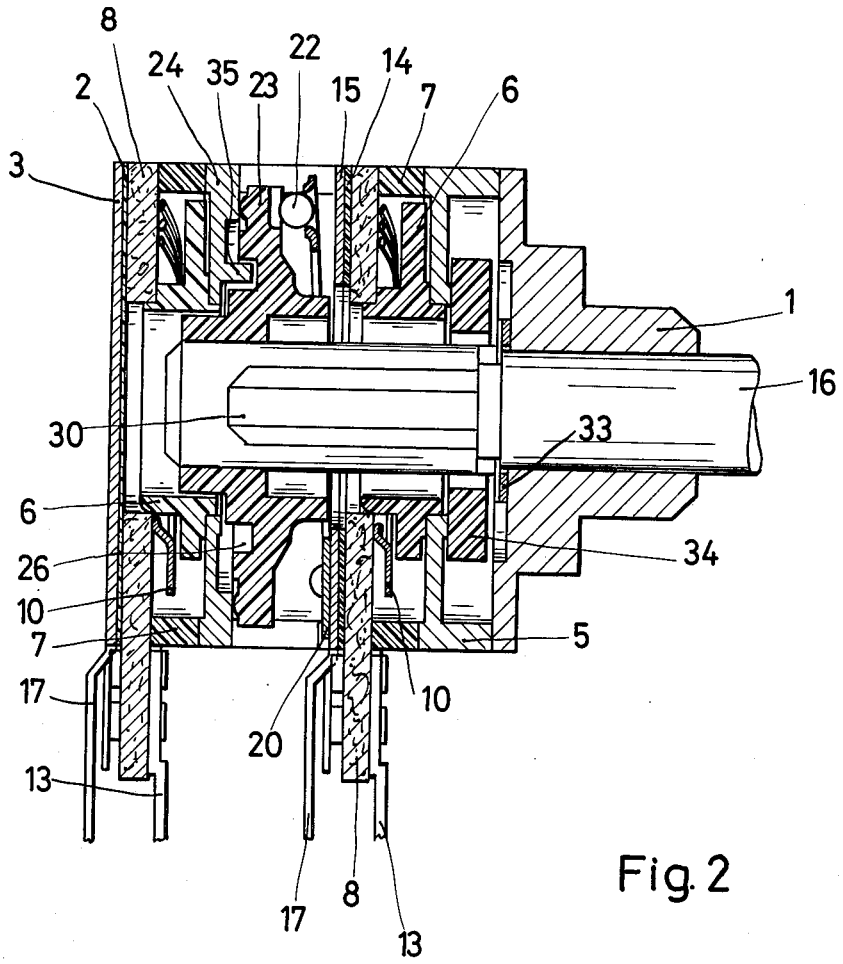
FIG. 2 shows a cross-sectional view through the variable resistor of FIG. 1.

FIG. 1 shows a first embodiment of the tandem variable resistor according to the invention in exploded, perspective view. A tandem resistor comprises two resistors which are variable by movement of a single actuation shaft. Such resistors are particularly needed for stereophonic purposes. It is to be noted, however, that because the resistor is constructed in modular fashion, many further combinations are realizable beyond simply the tandem arrangements illustrated here.

The tandem resistor shown in FIG. 1 comprises a hub-flange 1, two modular construction units, an insulating plate 2, and a shield plate 3. The entire tandem resistor assembly is held together by rivets 4. Each modular construction unit comprises essentially a pot-shaped housing frame 5, a spring carrier 6, an intermediate frame 7 of synthetic material, and a carrier plate 8. The spring carrier 6 is rotatably mounted in a central opening 9 of the housing frame. A contact spring 10 is mounted on the spring carrier, the slide contacts of the contact spring producing an electrical connection between the resistor course 11 and the collector course 12. The resistor course and the collector course are, according to conventional assembly procedures, mounted on the carrier plate. Connecting lugs 13, which are fastened by means of the clamp technique on the carrier plate, reach outwardly from the bottom of the housing. An insulating plate 14 is attached to the carrier plate 8 and is identical to the insulating plate 2. A shield plate 15 completes the first construction unit and has, in contrast to the shield plate 3, a central opening through which the actuation shaft 16 from the first unit extends into the second unit. Each of the shield plates has a solder connection lug 17 for soldering of the shield plate to a ground terminal of a printed circuit. Spring arms 18 molded integrally on opposite sides of the intermediate frame cooperate with and engage corresponding recesses in the carrier plate and the housing frame. The carrier plate recesses are designated as 19 in FIG. 1, while the recesses of the housing frame are not indicated in that Figure.

A generally O-shaped leaf spring 20 is mounted by one of its narrow sides on the shield plate 15, while on the opposite narrow side a recess 21 is provided in which a ball detent 22 is placed. The second construction unit also comprises essentially a housing frame 24, a spring carrier 6, an intermediate frame 7 of synthetic material, and a carrier plate 8, the spring carrier, with its contact spring 10, being mounted for rotation in the opening 9 in the back side of the housing frame 24. The front side of the housing frame is pot-shaped, the walls thereof being taller than those of the housing frame 5 of the first construction unit. A rotor 23 is mounted for rotation within the space defined by these walls and is provided with a circumferential click-stop contour on the face of the rotor turned away from the housing frame. The click-stop contour consists of radial slots 25 which are located around and extend inwardly from the rim of the rotor. An odd number of slots is provided in order to make possible a defined center position for audio adjustments. If precision adjustment capability of the resistor is desired, up to 41 slots and, hence, stop positions, can be provided. With much simpler apparatus a center stop suffices. Ball detent 22, resiliently biased by the leaf spring 20, engages the slots 25. The special configuration of the leaf spring and the click stop counter on the rotor makes possible 41 click-stop positions even when the variable resistor is constructed to relatively small dimensions.

Figure 3:
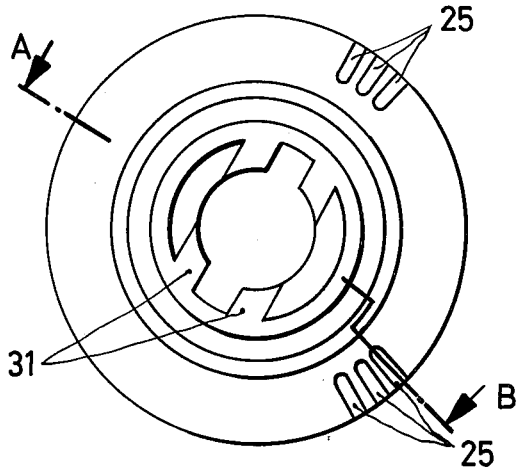
FIG. 3 shows a top view of the rotor of the variable resistor of FIGS. 1 and 2.
Figure 4:
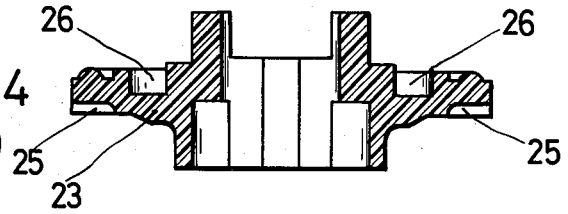
FIG. 4 shows a cross-sectional view taken along line A–B through the rotor of FIG. 3.
Figure 5:
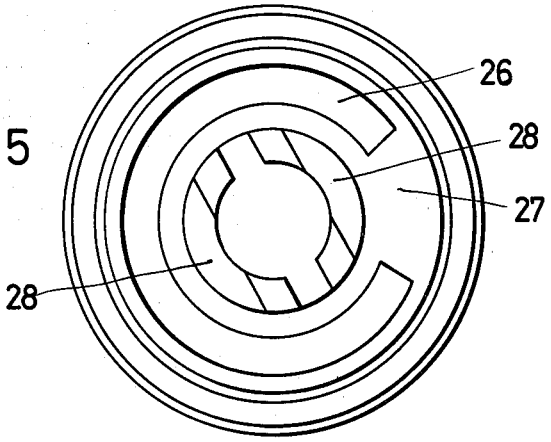
FIG. 5 shows a bottom view of the rotor of FIGS. 1 to 4.

The rotor 23 is shown in enlarged scale in FIGS. 3, 4 and 5 and has a circumferentially-running ring-shaped groove 26 on the face turned towards the housing frame, the ends of this groove being defined by an arresting segment 27. An arresting pin 35 extends into the groove, the arresting pin being integrally formed as a part of the housing frame. The arresting segment and the arresting pin cooperate to limit the rotation zone of the variable resistor. The rotor's click-stop contour preferably extends over the same angular region as the ring-shaped groove.

Rotor 23 is coupled with the spring carrier 6 by two diametrically-opposed, elevated ring segments 28. The ring segments mate with corresponding openings 29 of the spring carrier 6. An entrainment member 30 on the actuation shaft 16 cooperates with projections 31, 32 extending radially inwardly of the central opening of the rotor to cause the rotor and the spring carrier to rotate with the actuation shaft.

The actuation shaft 16 is secured in position in the opening of hub-flange 1 by means of a snap ring 33. Between the hub-flange and the first housing frame 5 is an intermediate spacer 34 which serves to assure that the distance from the housing wall, on which the hub-flange is fastended, to the connecting lugs 13 is in accordance with the grid of the printed circuit on which the resistor is to be mounted.

A further embodiment is shown in FIGS. 6 to 9. The tandem resistor shown in these Figures has synchronous precision which is somewhat better than in the first embodiment. In so far as the same components as in the first embodiment are used in the second embodiment, the same numbering is used.

Figure 6:
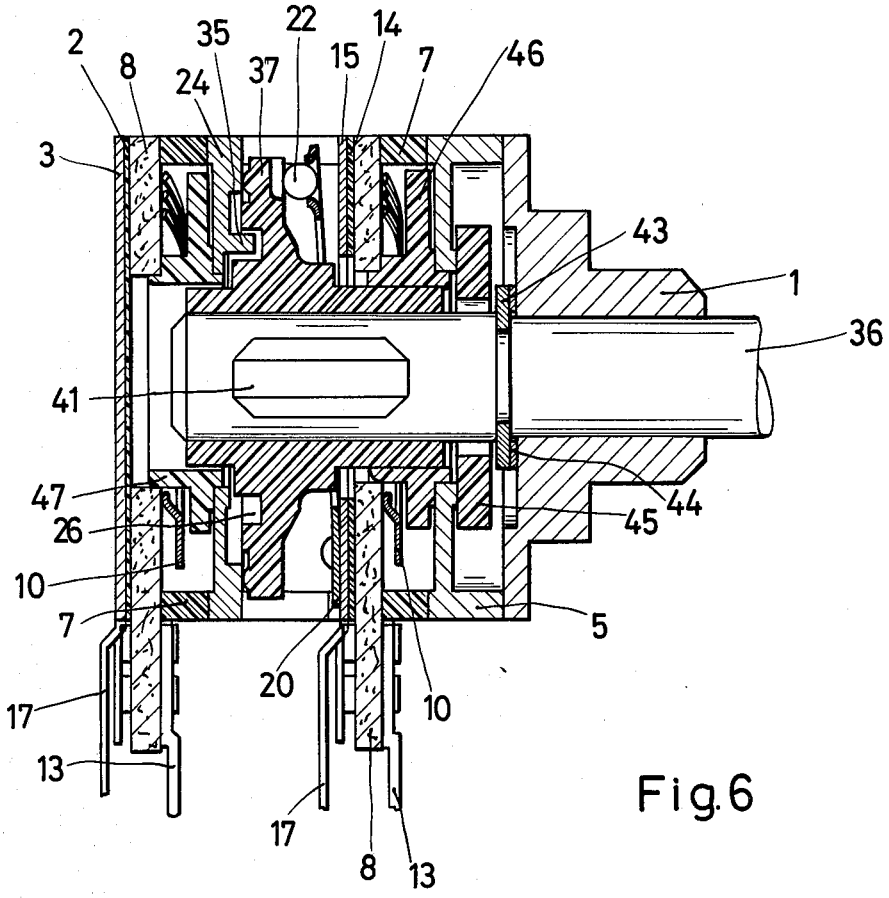
FIG. 6 shows a cross-sectional view through a further embodiment of a variable tandem resistor according to the invention.

The tandem resistor shown in cross-section in FIG. 6 consists of a hub-flange 1, two modular construction units, and an insulating plate 2 and a shield plate 3. The entire tandem resistor assembly is held together by a rivet or screw connection. Each modular unit essentially comprises a pot-shaped housing frame 5, a spring carrier 46, an intermediate frame 7 of synthetic material, and a carrier plate 8. The spring carrier is mounted for rotation in a central opening of the housing frame. A contact spring 10 is mounted on the spring carrier, the sliding contacts of the contact spring providing an electrical connection between the resistor course and the collector course. Both courses are mounted on the carrier plate according to conventional construction techniques. Connecting lugs 13, which are fastened by means of a clamp technique or by rivets on the carrier plate, extend outwardly from the bottom of the case. An insulating plate 14 is adjacent to the carrier plate 8, plate 14 being substantially identical with the insulating plate 2. The completion of the first construction unit is a shield plate 15 which has, in contrast to the shield plate 3, a central opening through which an actuation shaft 36 from the first unit extends into the second unit. Each of the shield plates has a solder-connection lug 17 for soldering of the shield plate to a ground terminal of a printed circuit.

Spring arms 18 (not illustrated in FIG. 6) formed integrally on opposite sides of the intermediate frame cooperate with and engage corresponding recesses in the carrier plate and the housing frame.

The second construction unit essentially also comprises a housing frame 24, a spring carrier 47, an intermediate frame 7 of synthetic material, and a carrier plate 8, the spring carrier with its contact spring 10 being mounted for rotation in an opening in the back side of housing frame 24. The front side of housing frame 24 is pot-shaped, the walls thereof being taller than those of housing frame 5. A rotor 37 is mounted for rotation in the space defined by these walls and is provided with a click-stop contour on the face of the rotor turned away from the housing frame. The click-stop contour consists of radial slots 38 which are located around and extend inwardly from the rim of the rotor. An odd number of slots is provided in order to make possible a defined center position for audio adjustments, as mentioned with regard to the first embodiment. Ball detent 22, resiliently biased by the leaf spring 20, engages the slots. The generally O-shaped leaf spring is fastened at a narrow side to the shield plate 15, while the opposite narrow side is provided with a recess in which the ball detent 22 is placed.

Figure 7:
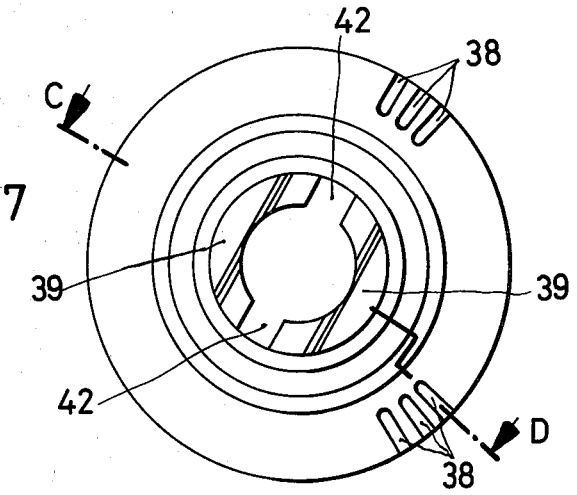
FIG. 7 shows a top view of the rotor of the variable resistor of FIG. 6.
Figure 8:
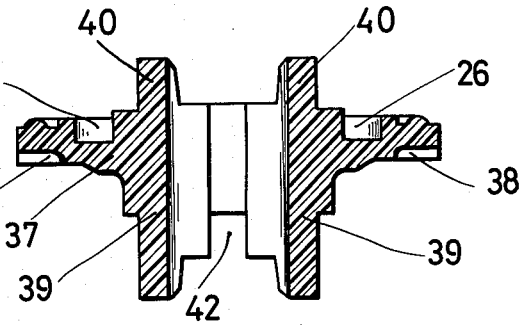
FIG. 8 shows a cross-sectional view taken along line C–D through the rotor of FIGS. 6 and 7.
Figure 9:
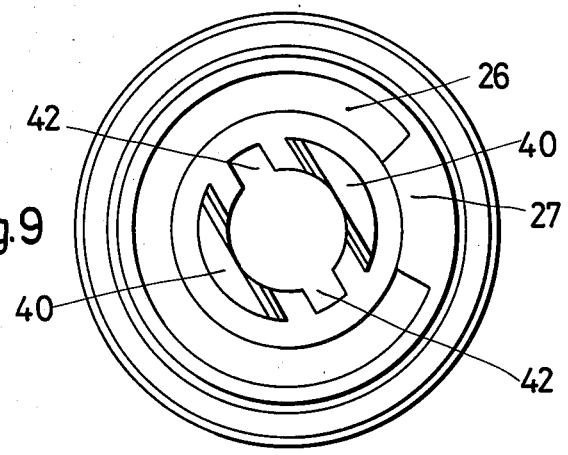
FIG. 9 shows a bottom view of a rotor of FIGS. 6 to 8.

Rotor 37 is shown in enlarged scale in FIGS. 7, 8, and 9, and has a circumferentially-running ring-shaped groove 26 on the rotor face turned towards the housing frame, the ends of this groove being defined by an arresting segment 27. An arresting pin 35 extends into the groove, the arresting pin being integrally formed as a part of the housing frame. The arresting segment and the arresting pin cooperate to limit the rotation zone of the variable resistor. The click-stop contour therefore preferably extends over the same angular region of the rotor as the ring-shaped groove.

Extending outwardly in the axial direction from the respective faces of the body of rotor 37 are integrally-formed ring segments 39, 40; each face of the rotor body has two diametrically opposed such ring segments. Spring carrier 47 is press-fit on the two shorter ring segments 40, while the other spring carrier 46 is press-fit on the longer ring segments 39. To guarantee a play-free coupling between the spring carriers and the rotor, the ring segments 39, 40 are tapered conically from a larger to a smaller diameter in the direction away from the rotor body. Thus, fully synchronous rotation of the two spring carriers is ensured. Entrainment members 41 located on the actuation shaft cooperate with slots 42 in the rotor to cause the rotor to rotate with the actuation shaft. The axial length of the entrainment members is less than the total axial length of the rotor body and ring segments, as can be seen from FIG. 6. The actuation shaft 36 is secured in position in the opening of the hub-flange by means of a snap ring 43 and a U-plate 44 of metal, the latter serving to improve the torsional moment. To prevent an axial displacement of the actuation shaft 36, a spacer disc 45 is provided, the spacer disc being preferably made of hard paper and rests against the housing frame 5.

What is claimed is:

1. An electrical device of modular design, comprising:

a hub flange;

a variable resistor module including a unitary housing frame, a spring carrier mounted for rotation with respect to said unitary housing frame, a contact spring mounted on said spring carrier and fixed for rotation with said spring carrier, a carrier plate mounted adjacent said spring carrier, and a resistance course and a collector course mounted on said carrier plate, said contact spring providing an electrical connection between said resistance course and said collector course;

an actuation shaft extending through said hub flange and said spring carrier and fixed for simultaneous rotation with said spring carrier;

a variable electrical circuit element module mounted in tandem with said variable resistor module and including a second unitary housing frame, an actuator mounted for rotation with respect to said second housing frame and drivingly connected with said shaft a carrier plate fixed with respect to said second unitary housing and mounted on the opposite side of said second unitary housing frame from said actuator, and spaced electrical circuit elements on said carrier plate to cooperate with rotation of said actuator to change their electrical characteristics;

at least one of said unitary housing frames being formed with a pot-shaped side facing the other unitary housing frame and having side walls defining a space;

a rotor rotatably mounted within the space defined by said side walls as a separate module between said variable resistor module and said variable electrical circuit element module, said rotor being drivingly connected to said shaft, and said rotor including stop contours arranged angularly;

means provided for arresting the rotation of said rotor to within predetermined angular limits; and at least one click-stop means resiliently biased against and engaging said rotor stop contours for indexing said shaft.

2. The device of claim 1, characterized in that said arresting means comprises a ring-shaped groove extending partially around one face of said rotor and an arresting pin protruding from said one housing frame and engaging said ring-shaped groove, the ends of said groove cooperating with said pin to define the rotation limits of said rotor.

3. The device of claim 1, characterized in that means are further included for coupling said rotor to said spring carrier for simultaneous rotation of said rotor and said spring carrier.

4. The device of claim 3, characterized in that said coupling means comprises ring segments extending axially from said rotor and for mating with corresponding openings in said spring carrier.

5. The device of claim 1, characterized in that an intermediate frame is interposed between said housing frame and said carrier plate, said intermediate frame having means for releasably engaging said housing frame and said carrier plate.

6. The device of claim 5, characterized in that said intermediate frame is constructed of synthetic material and said housing frame is constructed of metal.

7. The device of claim 5, characterized in that recesses are provided in said housing frame and said carrier plate, and said releasable engaging means comprises spring arms extending from said intermediate frame for engaging said recesses.

8. The device of claim 1, characterized in that said click-stop means comprises a resiliently-biased ball detent.

9. The device of claim 8, characterized in that said resiliently-biased ball detent comprises a leaf-spring for receiving a ball, and a ball seated in said recess, said leaf-spring being mounted on a metal plate, said metal plate forming a cover for the open end of said pot-shaped front side of said housing frame.

10. The device of claim 9, characterized in that said leaf-spring is substantially O-shaped and deviates from a circular form and has a central opening, said leaf-spring being fastened at one of its ends to said metal plate and having near the opposite end said recess for said ball detent.

11. The device of claim 2, characterized in that said rotor stop extends over the same angular region of said rotor as said ring-shaped groove.

12. The device of claim 1, characterized in that said rotor stop contours comprises a plurality of radially extending slots located in spaced relation about the rim of said rotor.

13. The device of claim 1, characterized in that said variable electrical circuit element module is a variable resistor assembly arranged along said actuation shaft and held together by at least one common connector, said variable resistor assembly comprising a spring carrier with contact spring, and a carrier plate having a resistance course and a collector course mounted thereon, said variable resistor further including an insulating plate and a shielding plate mounted on the carrier plate of the last said variable resistor assembly arranged along said actuation shaft.

14. The device of claim 1, characterized in that said actuation shaft includes at least one entrainment member which mates with projections extending radially inwardly of central-openings of said rotor and said spring carrier, whereby said rotor and said spring carrier are fixed for synchronous rotation with said actuation shaft.

15. An electrical device of modular design, comprising:

a potentiometer module having a stationary variable resistance and a rotatable resistance contact;

a variable electrical circuit element module having a rotatable actuator for changing its electrical characteristics;

a single rotor module separate from said modules and axially stacked with said modules with respect to a common axis of rotation, and said rotor module having stop means for cooperating with relatively stationary means of said device for click-stop indexing of said rotor about said axis of rotation;

each of said rotor module, said potentiometer module and said variable electrical circuit element module being spaced from each other, separate from each other, and functionally separate from each other;

a common actuator shaft extending axially through and into each of said modules for rotatably drivingly engaging each of said contact, actuator and rotor module; and means for releasably securing said modules and said actuator shaft in axially stacked relationship.

16. The device of claim 1, characterized in that said rotor comprises a rotor body and a plurality of integrally-formed ring segments of predetermined length extending outwardly in the axial direction from each face of said rotor body, the ring segments extending from one face of said rotor body being longer than the ring segments extending from the other face of said rotor body, at least the longer set of ring segments tapering conically from a larger diameter to a smaller diameter in the direction away from said rotor body and having a spring carrier press-fit thereon.

17. A device as in claim 1, characterized in that said actuation shaft includes an entrainment member for engaging with inwardly extending projections in an axial opening in said rotor for locking said rotor to said actuation shaft for synchronous rotation therewith, the axial length of said entrainment member along said actuation shaft being less than the total axial length of said rotor body and said ring segments.

18. The device of claim 1, characterized in that there are further provided releasable fastener means, each of which fixedly secures together said hub-flange, said first mentioned unitary housing frame, said second unitary housing frame, said first-mentioned carrier plate, and said second mentioned carrier plate, and the elements of each of said modules and said rotor, except for said fastening means, being freely axially stacked together, respectively with only axially releaseable positive interengagements with each other and said shaft, so that with removal of said fastening means, all of said modules, rotor and elements of said modules may be freely axially disassembled from each other.

19. A variable resistor of modular design, comprising a hub-flange, at least one unitary housing frame having a central opening, a spring carrier mounted for rotation within said opening, a contact spring mounted on said spring carrier, an actuation shaft extending through said hub-flange and said spring carrier and fixed for simultaneous rotation with said spring carrier, a carrier plate mounted adjacent said spring carrier, and a resistance course and a collector course mounted on said carrier plate, said contact spring providing an electrical connection between said resistance course and said collector course; characterized in that said at least one unitary housing frame is formed with a pot-shaped front side having side walls, a rotor is rotatably mounted within the space defined by side walls, means is provided for arresting the rotation of said rotor to within predetermined angular limits, said rotor includes stop contour means, and at least one click-stop device is resiliently biased against and engages said rotor stop contour means, an intermediate frame interposed between said housing frame and said carrier plate, said intermediate frame having means for releaseably engaging said housing frame and said carrier plate.

20. The variable resistor of claim 19 characterized in that said intermediate frame is constructed of synthetic material and said housing frame is constructed of metal.

21. The variable resistor of claim 19, characterized in that recesses are provided in said housing frame and said carrier plate, and said releasable engaging means comprises spring arms extending from said intermediate frame for engaging said recesses.

22. A variable resistor of modular design, comprising a hub-flange, at least one unitary housing frame having a central opening, a spring carrier mounted for rotation within said opening, a contact spring mounted on said spring carrier, an actuation shaft extending through said hub-flange and said spring carrier and fixed for simultaneous rotation with said spring carrier, a carrier plate mounted adjacent said spring carrier, and a resistance course and a collector course mounted on said carrier plate, said contact spring providing an electrical connection between said resistance course and said collector course, characterized in that said at least one unitary housing frame is formed with a pot-shaped front side having side walls, a rotor is rotatably mounted within the space defined by side walls, means is provided for arresting the rotation of said rotor to within predetermined angular limits, said rotor includes stop contour means, and at least one click-stop device is resiliently biased against and engages said rotor stop contour means, said variable resistor comprising two modular construction units, each of said units comprising a housing frame and a spring carrier, the spring carrier of each said construction units being connected with said rotor for simultaneous rotation with said rotor, said rotor being mounted on and fixed for synchronous rotation with said actuation shaft, and spring carriers of said contruction units being affixed to said rotor for synchronous rotation with said rotor and with each other, said rotor comprises a rotor body and a plurality of integrally-formed ring segments of predetermined length extending outwardly in the axial direction from each face of said rotor body, the ring segments extending from one face of said rotor body being longer than the ring segments extending from the other face of said rotor body, at least the longer set of ring segments tapering conically from a larger diameter to a smaller diameter in the direction away from said rotor body and having a spring carrier press-fit thereon.

23. The device of claim 15 characterized in that said rotor module is axially stacked between the other of said modules, and one of the other of said modules is provided with an outwardly extending recess receiving therein said rotor module.

24. The device of claim 15, wherein said potentiometer module and said variable electric circuit element module are identical and receive therebetween said rotor module, and wherein said device further includes a hub flange secured to the adjacent one of said modules at one axial end of the device and having a central guide opening for guidingly receiving therethrough the actuator shaft, and a shield plate secured to the adjacent module at the opposite axial end of said device.

25. The device of claim 24, further including releasable fastener means, each extending axially through said shield plate, said potentiometer module, said electrical circuit element module, and said hub flange.

26. The device of claim 1, wherein said variable resistor module and said variable electric circuit element module are identical and receive therebetween said rotor module, and wherein said device further includes a hub flange secured to the adjacent one of said modules at one axial end of the device and having a central guide opening for guidingly receiving therethrough the actuator shaft, and a shield plate secured to the adjacent module at the opposite axial end of said device.

27. The device of claim 26, further including releasable fastener means, each extending axially through said shield plate, said potentiometer module, said electrical circuit element module, and said hub flange.

* * * * *